US007749433B2

(12) United States Patent
Battaini

(10) Patent No.: US 7,749,433 B2
(45) Date of Patent: Jul. 6, 2010

(54) HIGH-HARDNESS PALLADIUM ALLOY FOR USE IN GOLDSMITH AND JEWELLER'S ART AND MANUFACTURING PROCESS THEREOF

(75) Inventor: Paolo Battaini, Castiglione Olona (IT)

(73) Assignee: 8853 S.p.A., Milan (IT)

( * ) Notice: Subject to any disclaimer, the term of this patent is extended or adjusted under 35 U.S.C. 154(b) by 611 days.

(21) Appl. No.: 11/468,857

(22) Filed: Aug. 31, 2006

(65) Prior Publication Data

US 2008/0063556 A1 Mar. 13, 2008

(30) Foreign Application Priority Data

Feb. 8, 2006 (IT) ..... TO2006A0086

(51) Int. Cl.
*C22C 5/04* (2006.01)
*C22C 5/00* (2006.01)
*C21D 1/00* (2006.01)
*B22D 27/02* (2006.01)

(52) U.S. Cl. ..... 420/463; 148/430; 148/567; 164/493

(58) Field of Classification Search ..... 420/463, 420/464, 465; 164/493; 148/430, 567
See application file for complete search history.

(56) References Cited

U.S. PATENT DOCUMENTS 2,478,225 A * 8/1949 Atkinson ..... 75/10.14
4,378,690 A * 4/1983 Stiebritz et al. ..... 72/467
4,580,617 A * 4/1986 Blechner et al. ..... 164/493

FOREIGN PATENT DOCUMENTS

JP 56123338 A * 9/1981

OTHER PUBLICATIONS

Davis et al., Induction Heat-Treating Equipment, 1998, Metals Handbook Desk Edition, ASM International, whole article.*
Kojima et al., English translation of JP 56-123338, 1980.*
Robertson, A.R., ASM Handbook- Precious Metals-Special Properties, 1992, ASM International,vol. 2, p. 1-4.*

* cited by examiner

*Primary Examiner*—Roy King
*Assistant Examiner*—Caitlin Fogarty
(74) *Attorney, Agent, or Firm*—Hahn & Voight PLLC; Jason D. Voight

(57) ABSTRACT

The invention relates to a high-hardness palladium alloy for manufacturing semi-finished products to be used in goldsmith's art or jewels to be obtained by the lost wax casting method, which comprises, in the following concentrations, expressed in thousandths by weight (‰): palladium from 948 to 990‰; copper from 0.0 to 50‰; indium from 0.0 to 50‰; gallium from 1 to 48‰; aluminium from 0.8 to 49.5‰; ruthenium from 0.0 to 50‰; rhenium from 0.0 to 50‰; silicon from 0.1 to 1.2‰; platinum from 0.0 to 40‰; nickel from 0.0 to 50‰; iridium from 0.0 to 40‰. In the manufacturing process of the above alloy, the component elements of said alloy are placed in a crucible, respectively made of zirconia, boron nitride or other ceramic material, and are melted using the induction method and using a protective atmosphere, respectively of argon, nitrogen or other inert gas.

19 Claims, 2 Drawing Sheets

HIGH-HARDNESS PALLADIUM ALLOY FOR USE IN GOLDSMITH AND JEWELLER'S ART AND MANUFACTURING PROCESS THEREOF

The object of the present invention is a palladium alloy with high hardness as compared to pure palladium or to other alloys of the same metal, to be used in goldsmith and jeweller's art, both for obtaining goldsmith semi-finished products and jewels manufactured by lost wax casting. The invention further relates to the process for manufacturing said high-hardness palladium alloy.

It is known that pure palladium (999‰) has very low hardness (about 50-80 Vickers) and that therefore, it cannot be used in the creation of jewels or goldsmith semi-finished products (wires, tubes, bars, plates, etc.). Hardness, which can reach the maximum values with the hardening produced by the mechanical processes, is too low to prevent wear. In particular, a low hardness comes together with poor mechanical properties (breaking stress and yield stress of the material). The material cannot be used as a jewel or semi-finished product as it would tend to wear out too quickly and moreover, it would get deformed by the simple handling or when subject to moderate stress. By adding other alloy elements to palladium it is possible to increase the hardness and improve the mechanical properties. Since the percentage of palladium allowed by the regulations in force for goldsmith alloys is equal to 950‰ by weight, the possible additions of secondary elements cannot exceed the concentration of 50‰. This restricts the possibilities of intervening on the chemical composition of the alloy and makes it necessary to find elements that should be highly efficient in changing the physical and mechanical properties, even with small additions thereof.

An object of the present invention is to provide a high-hardness palladium alloy for use in goldsmith and jeweller's art, whose mechanical features should be such as to make it suitable for mechanical processes, such as drawing, rolling, shearing, pressing, spinning. In particular, the object of the present invention is to provide an alloy of the type mentioned above, which should exhibit a Vickers hardness higher than 170 HV on the alloy still in the raw casting conditions.

Another object of the present invention is to provide a process for manufacturing a high-hardness palladium alloy for use in goldsmith and jeweller's art, which should be simple and safe to obtain.

In view of these objects, the present invention provides a high-hardness palladium alloy for use in the goldsmith and jeweller's art. Moreover, the present invention provides a process for manufacturing a high-hardness palladium alloy for use in the goldsmith and jeweller's art.

Further advantageous features are described herein.

The above claims are intended as integrally reported herein.

The present invention will appear more clearly from the following detailed description made with reference to the annexed pictures provided by way of a non-limiting example only, wherein.

Figure 1:
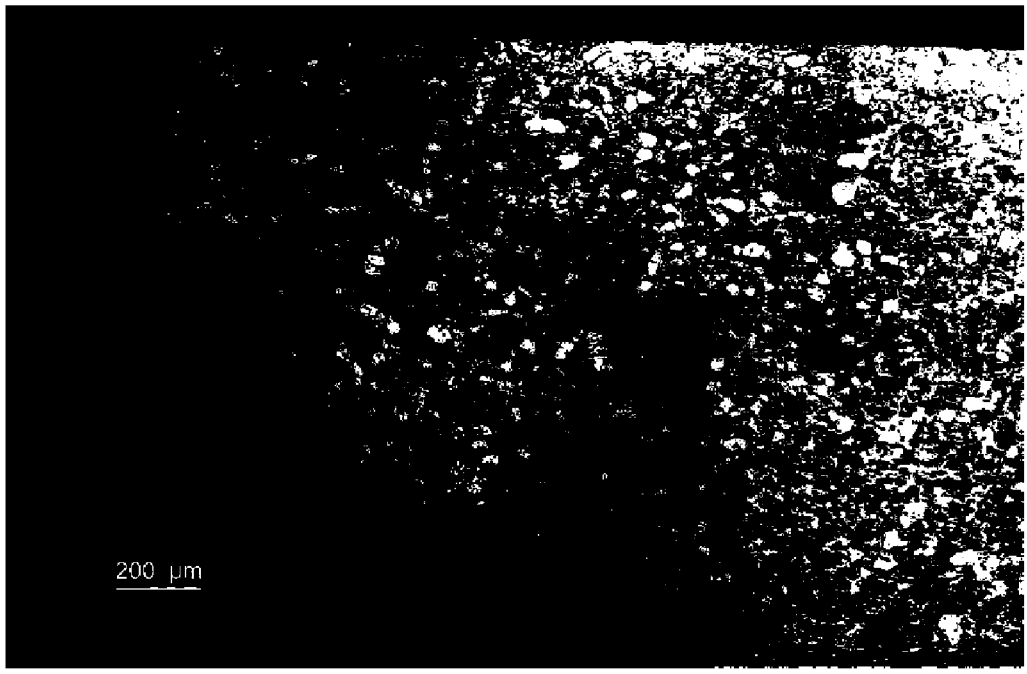
FIG. 1 is a micro-photography showing the cross section of a wedding ring (ring) made of a palladium alloy according to the invention.

The high-hardness palladium alloy, according to the present invention, for use in goldsmith and jeweller's art, belongs to the family of alloys having the following concentrations of elements, expressed in thousandths (‰):

palladium from 948 to 990‰, copper from 0.0 a 50‰, indium from 0.0 to 50‰, gallium from 1 to 48‰, aluminium from 0.8 to 49.5‰, ruthenium from 0.0 to 50‰, rhenium from 0.0 to 50‰, silicon from 0.1 to 1.2‰, platinum from 0.0 to 40‰, nickel from 0.0 to 50‰, iridium from 0.0 to 40‰. The experimental trials carried out have shown that the best combination of elements of the alloy according to the present invention is as follows (expressed as ‰ by weight):

| | |
|---|---|
| Palladium | 948.0 – 978.0 |
| Aluminium | 8.0 – 32.0 |
| Gallium | 23.0 – 29.0; resp. 29.0 – 42.0 |
| Ruthenium | 0.01 – 0.06 |
| Indium | 0.02 – 1.8 |
| Rhenium | 0.01 – 0.06 |

Preferably, palladium is used in concentrations comprised between 950 and 952‰, in order to ensure the minimum percentage required by law. The contents of ruthenium and rhenium are variable between 0.01 and 0.06‰, in order to ensure sufficient refining of the crystalline grain, which is especially important when the alloy according to the invention is used for fusion with the lost wax casting method.

Gallium and aluminium are the elements that produce an increase of the hardness of the above alloy, both in combination with each other and individually. In fact, the alloy itself exhibits a Vickers hardness equal to 180 HV 10/30 on the raw cast material, that is, not work-hardened further by mechanical processing. The experiments carried out show that the mechanical processing produces a further increase of the hardness of the alloy according to the invention, which can achieve 320 HV 10/30 without any breakage of the semi-finished product. The elements in the alloy do not make the alloy itself become brittle, as it maintains excellent properties of mechanical workability, both in drawing and in rolling. FIG. 1 shows the microstructure of the typical alloy in the section of a wedding ring obtained by mechanical processing of a washer sheared from a rolled section. A fine crystalline grain is observed (mean dimensions of 40 μm), obtained by re-crystallization of the material subsequent to annealing. Said alloy exhibits a hardness equal to 230 HV, which is ideal for an excellent resistance to wear during the use of the ring. Such hardness is even higher than that obtained with platinum alloys for the same type of product. In the standard usage conditions, the ring is indeformable.

Figure 2:
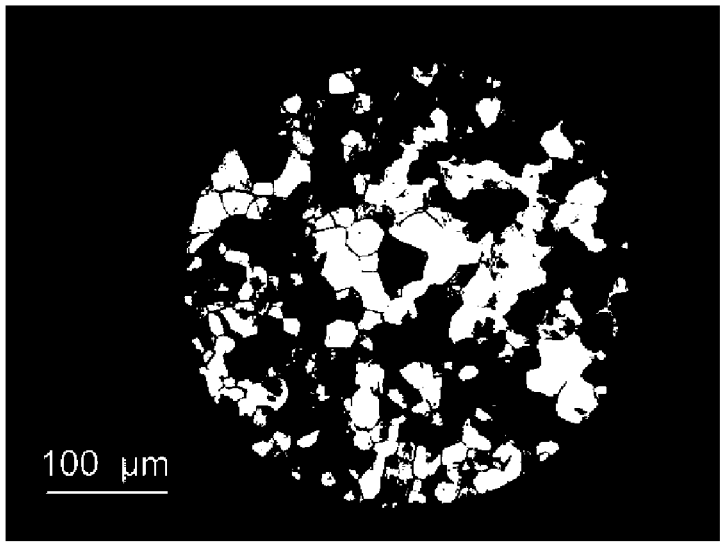
FIG. 2 is a micro-photography showing the cross section of a high-hardness palladium alloy wire according to the invention.

FIG. 2 shows the cross section of a wire made of the palladium alloy according to the invention, obtained by drawing. The wire hardness is equal to 240 HV and the crystalline grain exhibits mean dimensions of 40 μm. The micro-structural conditions of the wire are ideal for use as semi-finished product in the manufacture of jewels.

Figure 3:
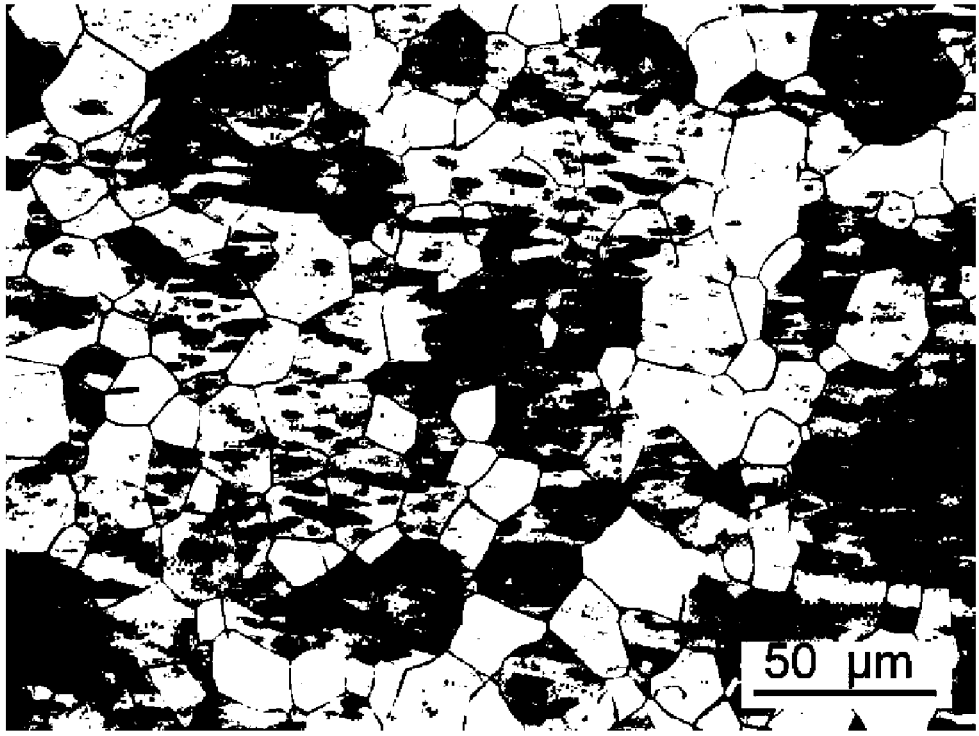
FIG. 3 is a microphotography showing the overall appearance of the alloy microstructure in the re-crystallized conditions, after mechanical processing.

FIG. 3 shows the overall appearance of the alloy microstructure according to the invention in the re-crystallized conditions, after mechanical processing. In general, said alloy exhibits excellent micro-structural homogeneity and absence of brittling brittle phases.

The alloy according to the invention is also suitable for being welded by arc welding with tungsten gas (TIG or GTAW) and laser beam welding. The chemical composition thereof exhibits no contraindications to the application of these two welding methods.

In the practical use, the component elements of the alloy according to the invention are placed in a crucible made of zirconia or boron nitride or other ceramic material and are melted using the induction method and using a protective atmosphere of argon, nitrogen or other inert gas. The alloy can be cast in a rectangular section plate or in a square section bar and can then be processed by rolling, both in plate and in square, or it can be drawn using die plates with diamond core. In particular, the alloy according to the invention is produced by placing the alloy elements in the form of rolled section or shots in a crucible made of zirconia or boron nitride. The crucible, along with the material, is introduced into a reel belonging to an induction melting furnace. The frequency of the induction field may range from 10 KHz to 1 MHz but, preferably, it is equal to 10 KHz. The material is melted into a chamber first evacuated and then filled with argon gas at the pressure of 0.8 ATM. Once the alloy has melted, the casting is carried out, still in argon atmosphere, in a flask made of copper or copper-beryllium alloy.

The shapes of the ingot obtained by casting may vary from the rectangular section to the square or circular section. The ingot weight may vary from 400 g to a few Kg, based on the crucible capacity.

The invention claimed is:

1. A high-hardness palladium alloy for manufacturing semi-finished products to be used in goldsmith's art or jewels to be obtained by the lost wax casting method, characterized in that it comprises, in the following concentrations, expressed in thousandths by weight (‰): palladium from 948 to 990‰; copper from 0.0 to 50‰; indium from 0.0 to 50‰; gallium from 1 to 48‰; aluminium from 0.8 to 49.5‰; ruthenium from 0.0 to 50‰; rhenium from 0.01 to 0.06‰; silicon from 0.1 to 1.2‰; platinum from 0.0 to 40‰; nickel from 0.0 to 50‰; iridium from 0.0 to 40‰.

2. A high-hardness palladium alloy according to claim 1, characterized in that it comprises the components in the following concentrations expressed in thousandths by weight (‰): palladium from 948.0 to 978.0‰; aluminium from 8.0 to 32.0‰; gallium from 23.0 to 42.0‰; ruthenium from 0.01 to 0.06‰; indium from 0.02 to 1.8‰; rhenium from 0.01 to 0.06‰.

3. A high-hardness palladium alloy according to claim 1, characterized in that it exhibits a Vickers hardness equal to 180 HV 10/30 on the raw cast material.

4. A high-hardness palladium alloy according to claim 1, characterized in that it exhibits an increase of the hardness subsequent to the mechanical processing, up to 320 HV 10/30, without any breakage of the semi-finished product.

5. A high-hardness palladium alloy according to claim 1, characterized in that it comprises ruthenium from 0.01 to 0.06‰.

6. A process for manufacturing the high hardness palladium alloy according to claim 1, characterized in that the component elements of the alloy are placed in a crucible, respectively made of zirconia, boron nitride or other ceramic material, and are melted using the induction method and using a protective atmosphere, respectively of argon, nitrogen or other inert gas.

7. A process according to claim 6, characterized in that said alloy is produced by placing the alloy elements in the form of rolled section, respectively of shots, in a crucible, respectively made of zirconia, boron nitride or other ceramic material; said crucible, along with the material, is placed into a reel belonging to an induction melting furnace, the frequency of the induction field being comprised between 10 KHz and 1 MHz; the material is melted in a chamber first evacuated and then filled with argon gas at the pressure of 0.8 ATM; once the alloy has melted, the casting is carried out, still in argon atmosphere, respectively in a flask made of copper or copper-beryllium alloy.

8. A process according to claim 6, characterized in that said alloy is cast in a rectangular section plate, and then is processed by rolling, it is drawn using die plates with diamond core.

9. A process according to claim 6, characterized in that an ingot obtained by casting exhibits a rectangular section, square section, or circular section.

10. A process according to claim 6, characterized in that the weight of an ingot obtained by casting ranges from 400 g to a few Kg, based on the crucible capacity.

11. A process according to claim 6, characterized in that said alloy is welded by arc welding with tungsten gas.

12. A process according to claim 6, characterized in that said alloy is welded by laser beam welding.

13. A process according to claim 7, characterized in that the frequency of the induction field is 10 KHz.

14. A process according to claim 8, characterized in that said alloy is cast in a square section bar.

15. A method for obtaining goldsmith semi-finished products or jewels manufactured by lost wax casting, said method comprising drawing, rolling, shearing, pressing or spinning the alloy of claim 1.

16. A high-hardness palladium alloy for manufacturing semi-finished products to be used in goldsmith's art or jewels to be obtained by the lost wax casting method, characterized in that it comprises in the following concentrations, expressed in thousandths by weight (‰): palladium from 948 to 990‰; copper from 0.0 to 50‰; indium from 0.02 to 1.8‰; gallium from 1 to 48‰; aluminium from 0.8 to 49.5‰; ruthenium from 0.0 to 50‰; rhenium from 0.0 to 50‰; silicon from 0.1 to 1.2‰; platinum from 0.0 to 40‰; nickel from 0.0 to 50‰; iridium from 0.0 to 40‰.

17. A high-hardness palladium alloy according to claim 16, characterized in that it comprises rhenium from 0.01 to 0.06‰.

18. A high-hardness palladium alloy according to claim 16, characterized in that it comprises an amount of ruthenium or rhenium.

19. A high-hardness palladium alloy according to claim 16, characterized in that it comprises from 0.01‰ to 50‰ of ruthenium or rhenium.

* * * * *